United States Patent [19]

Weetman et al.

[11] 3,996,144

[45] Dec. 7, 1976

[54] RUST INHIBITORS AND LUBRICANT COMPOSITIONS CONTAINING SAME

[75] Inventors: David G. Weetman, Hopewell Junction; Jackson W. Wisner, Jr., Wappingers Falls; David M. Stehouwer, Fishkill, all of N.Y.

[73] Assignee: Texaco Inc., New York, N.Y.

[22] Filed: Oct. 23, 1975

[21] Appl. No.: 625,296

[52] U.S. Cl. ..... 252/56 R; 184/1 E; 252/52 R; 252/396

[51] Int. Cl.[2] ..... C10M 1/24

[58] Field of Search ..... 252/56 R, 52 R, 396

[56] References Cited

UNITED STATES PATENTS

| | | | |
|---|---|---|---|
| 2,204,601 | 6/1940 | Kavanagh et al. | 252/56 R X |
| 2,582,708 | 1/1952 | Lippincott et al. | 252/56 R |
| 2,660,563 | 11/1953 | Banes et al. | 252/56 R |
| 3,066,159 | 11/1962 | DeGroote et al. | 252/56 R X |
| 3,856,691 | 12/1974 | Haugen et al. | 252/52 R |
| 3,932,532 | 1/1976 | Hunter et al. | 252/396 X |
| 3,948,976 | 4/1976 | Suen et al. | 252/396 X |

*Primary Examiner*—Delbert E. Gantz
*Assistant Examiner*—Andrew H. Metz
*Attorney, Agent, or Firm*—T. H. Whaley; C. G. Ries; Henry W. Archer

[57] ABSTRACT

Ashless rust-inhibited lubricating oil compositions comprising a major portion of a mineral lubricating oil, and a minor, rust inhibiting amount of a polyhydric ester represented by the formula:

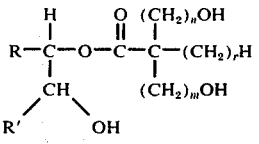

in which R and R′ are hydrogen or hydrocarbyl radicals having from 1 to 24 carbon atoms, *r*, *m* and *n* are integers ranging from 0 to 10.

6 Claims, No Drawings

RUST INHIBITORS AND LUBRICANT COMPOSITIONS CONTAINING SAME

BACKGROUND OF THE INVENTION

1. Field of the Invention

This invention pertains to an ashless mineral lubricating oil composition which has been modified to enhance its rust inhibiting properties by the addition thereto of a hydrocarbyl substituted polyhydric ester.

2. Description of the Prior Art

The art to which this invention relates is already aware, inter alia, of the following U.S. Pat. Nos. 1,888,023; 2,353,830; 3,458,444 and 3,794,586.

U.S. Pat. No. 1,888,023 discloses a color-stabilized lubricating oil composition containing a primary, secondary or tertiary aliphatic amine or hydroxyalkylamine.

U.S. Pat. No. 2,353,830 discloses a lubricant for an air pump containing tri-ethanolamine stearate and comprising 80 percent of water.

U.S. Pat. No. 3,458,444 discloses a rust inhibited mineral lubricating oil composition containing the reaction product of an alkenylsuccinic acid or anhydride and an N-hydrocarbyl diethanolamine.

U.S. Pat. No. 3,794,586 describes a lubricating oil composition containing a hydroxyalkyl-substituted polyamine.

SUMMARY OF THE INVENTION

Viewed in its composition aspect, the present invention discloses a rust inhibited lubricating oil composition comprising a mineral oil base of lubricating viscosity and a minor, rust-inhibiting, amount of a polyhydric ester represented by the formula:

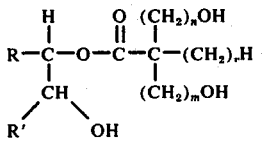

wherein R and R′ are hydrogen or hydrocarbyl radicals having from 1 to 10 carbon atoms and can be the same or different substituents and *m*, *n* and *r* are integers ranging from 0 to 10 and can be the same or different.

A preferred composition aspect of the invention is a lubricant comprising a major portion of a mineral lubricating oil having an SUS viscosity at 100° F. in the range of 50 to 300 containing from about 0.01 to about 5% weight percent of a polyhydric ester as above set forth wherein R′ is hydrogen or hydrocarbyl radical having from 1 to 4 carbon atoms, R is a hydrocarbyl radical having from 4 to 16 carbon atoms and, *n*, *m* and *r* range from 1 to 3.

Viewed in its broadest aspect, the present invention resides in the concept of lubricating an internal combustion engine which comprises adding a lubricating oil composition of the character described to the crankcase of the engine and contacting the engine parts including the push rods thereof with the present lubricating composition.

The compounds of the invention can be prepared by the reaction shown in the following equation wherein the symbols have the significance noted above:

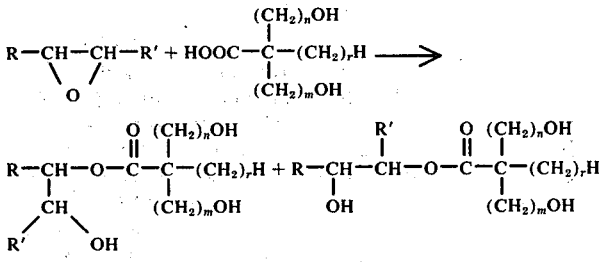

It is recognized that mixtures of closely related chemicals species can originate from the reaction shown. These materials are included along with the principal product. These materials also have antirust properties. The alpha olefin reactant which can be employed is a straight chain aliphatic hydrocarbon having from about 1 to 24 carbon atoms characterized by having an olefin oxide functional group at one end of the chain. These materials are typically obtained in commerce as mixtures of alpha olefin epoxides. The mixtures of $C_{11}$-$C_{14}$, $C_{12}$-$C_{14}$ and $C_{15}$-$C_{18}$ epoxides are typical of the reagents employed for the preparation of the invention and to prepare the products that are preferred species of the invention. Other examples of suitable epoxides for this synthesis are shown in Table I.

TABLE I 1,2-epoxyoctane
2,3-epoxyoctane
4,5-epoxyoctane
1,2-epoxydodecane
1,2-epoxytetradecane
1,2-epoxyhexadecane
1,2-epoxyoctadecane
3,4-epoxydecane
2,3-epoxydecane Examples of other suitable polyhydric acids for this invention are shown in Table II.

TABLE II diethylol propionic acid
dipropylol propionic acid
dibutylol propionic acid
dipentylol propionic acid
dihexylol propionic acid Unsymmetrical polyhydric acids of the general structure represented by *n* unequal to *m* are also included in this category.

To prepare the subject compounds the reactants are brought together in stoichiometric amounts in a reaction vessel and gradually heated until the reaction commences which will generally be in the range of 150° to 170° C. Since the reaction is exothermic in nature, heating is discontinued when the exotherm begins. The reaction temperature increases autogenously to a range of 190°–200° C. The reaction mixture is maintained in the temperature range of 160°–180° C for about 15 to 60 minutes after which the reaction product is allowed to cool to room temperature. Any compounds of the types illustrated in Table I can be reacted with those illustrated in Table II to produce the prescribed substituted esters.

The following examples illustrate the preparation of specific ashless substituted polyhydric esters additives employed in the present invention.

EXAMPLE I 410 grams (2.0 moles) of a $C_{11}$–$C_{14}$ straight chain alpha olefin epoxide mixture and 268 grams (2.0 moles) of dimethylol propionic acid were charged to a reaction vessel. The stirred mixture was gradually heated to 150°–170° C where a mild exothermic reaction occurred; the heating source was removed and the reaction temperature rose autogenously to 190°–200° C. The reaction mixture was kept in the temperature range of 160°–180° C for 15 to 60 minutes, then cooled to room temperature. 625 grams of product was realized which had the formula:

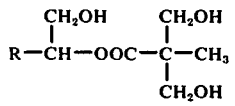

where R ranges from $C_{11}$ to $C_{14}$.

EXAMPLE II 453 grams (3.5 moles) octane oxide and 402 grams (3.0 moles) dimethylol propionic acid were charged to a reaction vessel and reacted and recovered as in Example I above. There were collected 810 grams of a product having the formula:

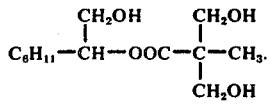

The base oil for the lubricant of the invention can be predominantly paraffinic or naphthenic or it can be a mixture of both types of mineral oils. In general, the base oil will be a relatively highly refined mineral oil of predominantly paraffinic nature and will have a viscosity in the range of about 50 to about 500 Saybolt Universal Seconds at 210° F.

The polyhydric esters of the invention are particularly useful for preparing ashless rust-inhibited lubricating oil compositions. It is understood that a concentrate of the polyhydric esters can be prepared in a suitable vehicle which can be employed for preparing the lubricating oil composition of the invention.

Certain conventional mineral oil additives can be employed in the formulation of a fully balanced lubricating composition employing the improvement of this invention. Effective conventional antioxidants include the diphenylamines, such diphenylamine and the $C_1$ to $C_{12}$ alkylated diphenylamine, the phenyl naphthylamines and the methacrylate copolymers to improve the visocisyt index of the oil.

The rust inhibiting properties of the novel lubricant of the invention were determined in the Bench IIC Rust Test. This Test was developed and is effective for evaluating crankcase oils with respect to low temperature rusting and has been correlated with the SE required standard MS-IIC Rust Test.

According to the Bench IIC Rust Test a gaseous mixture of nitrogen oxides (NOx), water vapor and air are simultaneously passed through a cell containing a test oil and a cell containing a standard lubricant formulation under specified conditions of temperature and for a specific length of time. The standard formulation can be any lubricant system for which the rusting characteristics or average rust rating have been established in the MS-IIC Engine Rust Test; an average rust rating, obtained by visually rating the degree of rusting on a variety of engine parts including pushrods, is given for each MS-IIC Engine Rust Test. The rusting characteristics of an oil in the Bench IIC Rust Test are determined by visually rating a section of an engine pushrod placed in the test oil and standard oil during the test. The relative degree of rusting of the pushrod section surrounded by the test oil can be determined and compared to that occurring in the standard oil. Having established the rusting characterisitcs of the standard oil in the MS-IIC Engine Test, a prediction of the rust protecting ability of the test oil under Engine Test conditions can then be made. In practice, the standard lubricant employed in the Bench IIC Rust Test is one which gives a failing rust rating in the Engine Test of 6.1; a minimum average rust rating of 8.4 is required to satisfy SE qualification. It has been determined that an experimental formulation achieving a rust rating of 7.5 or greater in the Bench Test can be expected to achieve a passing or near passing result in the engine test.

The base oil employed for preparing the lubricant of this invention for testing in the foregoing Bench Test was an essentially paraffinic base oil having an SUS viscosity at 210° F of about 40.

A summary of evaluations appears in Table III.

TABLE III

TABLE III : EVALUATION OF ASHLESS RUST INHIBITORS IN MS-IIC ENGINE RUST TEST & BENCH IIC RUST TEST

| Lubrication Oil Composition | | A | B | C | D | E | F | G | H | I |
|---|---|---|---|---|---|---|---|---|---|---|
| Basic Calcium Sulfonate (% Ca) | (1) | 0.10 | 0.15 | 0.23 | 0.12 | 0.16 | 0.14 | 0.14 | 0.16 | 0.16 |
| Zinc Dialkyldithiophosphate (% Zn) | (2) | 0.12 | 0.12 | 0.12 | 0.07 | 0.10 | 0.08 | 0.08 | 0.05 | 0.05 |
| Zinc Diaryldithiophosphate (% Zn) | (3) | — | — | — | — | — | — | — | 0.05 | 0.05 |
| Mono(B-hydroxyethyl)alkane thiophosphate | (4) | 0.05 | 0.05 | 0.05 | — | — | — | — | 0.07 | 0.07 |
| Pentaerythritol Ester of ASAA | (5) | — | — | — | 3.00 | 4.00 | 5.00 | 4.00 | — | — |
| Methacrylate VI Improved | (6) | 4.75 | 4.75 | 4.75 | 9.00 | 4.25 | 0.85 | 4.25 | 4.25 | 4.25 |
| Ethylene Propylene VI Improved | (7) | — | — | — | — | 5.90 | — | 5.75 | 5.90 | 5.90 |
| Alkylated Diphenylamine | (8) | 0.35 | 0.35 | 0.35 | 0.25 | 0.35 | — | — | 0.35 | 0.35 |
| Sulfurized cyclohexene | (9) | — | — | — | — | — | 0.25 | 0.50 | — | — |
| Ethoxylated Alkylphenol | (10) | — | — | — | — | 0.50 | — | — | — | — |
| Alkyl Substituted Triethanolamine | (11) | — | — | — | — | 0.02 | — | — | — | — |
| EXAMPLE I | | — | — | — | — | — | 0.10 | 0.50 | — | — |
| EXAMPLE II | | — | — | — | — | — | — | — | — | 0.25 |
| MS-IIC Engine Evaluation | | | | | | | | | | |

TABLE III-continued

TABLE III : EVALUATION OF ASHLESS RUST INHIBITORS IN MS-IIC ENGINE RUST TEST & BENCH IIC RUST TEST

| Lubrication Oil Composition | A | B | C | D | E | F | G | H | I |
|---|---|---|---|---|---|---|---|---|---|
| Lifter bodies | 4.9 | 7.9 | 8.0 | 6.2 | 8.1 | 7.8 | 7.8 | — | — |
| Lifter plungers | 5.9 | 8.4 | 8.8 | 5.4 | 8.0 | 7.7 | 8.9 | — | — |
| Lifter balls | 3.3 | 7.0 | 8.5 | 3.8 | 5.4 | 5.5 | 8.4 | — | — |
| Relief valve plungers | 3.5 | 6.5 | 7.4 | 3.6 | 8.5 | 4.1 | 7.8 | — | — |
| Pushrods | 6.1 | 8.4 | 8.9 | 6.8 | 8.8 | 8.6 | 8.8 | — | — |
| Average Rust Rating | 4.7 | 7.6 | 8.3 | 5.2 | 7.8 | 6.7 | 8.3 | — | — |
| BENCH IIC RUST RATING | — | — | — | — | — | — | — | 7.3 | 8.7 |

(1) 300 TBN Calcium Carbonate Overbased Calcium Sulfonate
(2) Zinc di-$C_6$-$C_7$ alkyl Dithio Phosphate
(3) Zinc di-Nonylphenol Dithiophosphate
(4) Dispersant
(5) Dispersant
(6) Tetrapolymer of Butyl, Lauryl, & Dimethylaminoethyl Methacrylate
(7) Ethylene Propylene Copolymer
(8) Mixture of Diethyl Mono & Di-tert octyldiphenylamine
(9) Anti-oxidant
(10) Surfonic N-40, Ashless Rust Inhibitor
(11) Ashless Rust Inhibitor

What is claimed is:

1. An ashless lubricating oil composition comprising a major portion of a mineral lubricating oil, and a minor, rust-inhibiting, amount of a polyhydric ester represented by the formula:

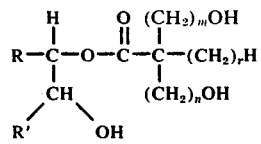

in which R and R′ are hydrogen or hydrocarbyl radicals having from 1 to 24 carbon atoms; *n, m,* and *r* range from 0 to 10.

2. A lubricating oil composition according to claim 1 containing from about 0.01 to about 5 weight percent of said polyhydric ester.

3. A lubricating oil composition according to claim 1 in which R represents a saturated aliphatic hydrocarbon radical having from 4 to 16 carbon atoms, R′ is hydrogen or an alkyl group having from 1 to 4 carbon atoms, and *n*, *m*, and *r* range from 1 to 3.

4. A lubricating oil composition according to claim 1 in which said polyhydric ester has the formula:

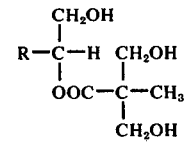

and R is $C_{11}$ to $C_{14}$.

5. A lubricating oil composition according to claim 1 in which said polyhydric ester has the formula:

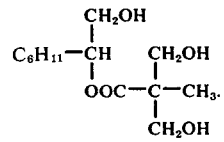

6. A process for lubricating an internal combustion gasoline engine which comprises adding a lubricating oil composition as set forth in claim 1 to the crankcase of said engine and contacting the engine parts including push rods with said composition.

* * * * *